US005334811A

United States Patent [19]

Burgener et al.

[11] Patent Number: 5,334,811

[45] Date of Patent: Aug. 2, 1994

[54] SWITCH WITH LAMINATED COVER

[75] Inventors: JoAnne M. Burgener; Arthur W. Dawson, both of Stephenson, Ill.

[73] Assignee: Honeywell Inc., Minneapolis, Minn.

[21] Appl. No.: 63,378

[22] Filed: May 17, 1993

[51] Int. Cl.[5] ..... H01H 21/08

[52] U.S. Cl. ..... 200/302.3; 200/335

[58] Field of Search ..... 200/302.3, 335, 302.2

[56] References Cited

U.S. PATENT DOCUMENTS

| | | | |
|---|---|---|---|
| 2,565,863 | 8/1951 | Linn | 200/302.3 X |
| 3,184,578 | 5/1965 | Dennison | 200/302.2 |
| 3,987,266 | 10/1976 | Betz | 200/302.2 |
| 4,835,348 | 5/1989 | Poling et al. | 200/302.2 |

FOREIGN PATENT DOCUMENTS

| | | | |
|---|---|---|---|
| 1136160 | 12/1968 | United Kingdom | 200/302.3 |

*Primary Examiner*—Renee S. Luebke
*Attorney, Agent, or Firm*—William D. Lanyi

[57] ABSTRACT

A switch housing is made with a laminated cover that comprises an inner plate, an outer plate and a metallic sheet that is disposed therebetween. The metallic sheet is formed with a raised portion that defines a raised surface that is a deformable membrane. The protrusion formed in the metallic sheet is disposed through an opening in an outer plate. An inner plate has an opening which is aligned with the opening of the outer plate and the three laminae are spot welded together to define a cover. The laminated cover is welded to a housing with a switching mechanism disposed therein. The deformable membrane of the protrusion formed in the sheet can be attached to a pin that has an outer portion and an inner portion. The outer portion is attached to an external lever and the inner portion is attached to an internal lever. The internal lever is disposed in operative association with a switching mechanism to change the connection status of the switching mechanism in response to movement of the outer lever. The laminated cover eliminates the need for brazing a cup-shaped lever to a cover plate in the region of the deformable membrane.

6 Claims, 3 Drawing Sheets

SWITCH WITH LAMINATED COVER

BACKGROUND OF THE INVENTION

1. Field of the Invention

The present invention is generally related to switches with deformable membranes formed as part of the switch housing and, more particularly, to a switch which incorporates a laminated cover with a central sheet disposed between two plates, wherein the central sheet is shaped to define a raised deformable membrane extending through an opening in one of the plates and aligned with an opening in the other plate.

2. Description of the Prior Art

Hermetically sealed switches which incorporate a deformable membrane as part of the switch housing are known to those skilled in the art and are commercially available from MICRO SWITCH, A Division of Honeywell, as identified by Catalog Listing HM. As will be described in greater detail below in conjunction with FIGS. 1 and 2, the known way to manufacture a hermetically sealed switch of this type is to form a cover plate with an opening therethrough and separately form a cup-shaped member having a generally circular deformable membrane as a surface thereof. The cup-shaped member is then inserted through the opening in the cover plate and an annular rim of the cup-shaped member is brazed to the plate around the edge of the opening in the plate. A pin is brazed into a hole in the center of the cup shaped member. External and internal levers are attached to the pin in the deformable membrane to permit actuation of a switching mechanism by the internal lever in response to movement of the external lever. Although this particular design of switch has worked satisfactorily for many years, the connection between the cup-shaped member and the cover plate is subject to significant process variability during manufacture. This process variability can reduce the corrosion resistance of the switch, adversely affect its mechanical life or lead to sealing failures. It would therefore be beneficial if a switch of this general type could be made in a way that reduces or eliminates the variability of the manufacturing process which can result in failures in the region where the cup-shaped member is brazed to the cover plate.

SUMMARY OF THE INVENTION

A preferred embodiment of the present invention provides a switch which comprises a housing and a switching mechanism disposed within the housing. A cover is attached to the housing to enclose the switching mechanism therein. The cover is a laminated structure comprising an outer plate, an inner plate and a metallic sheet disposed therebetween. The sheet is formed to have a protrusion therein to define a raised portion having a generally circular cross-section. The raised portion has a generally circular raised surface connected to a planar portion of the sheet by a generally annular wall portion. The outer plate has a circular first opening therethrough and the protrusion of the sheet is disposed through the first opening. The inner plate has a circular second opening therethrough. The first and second openings of the outer and inner plates, respectively, are aligned with each other and the sheet is confined between the inner and outer plates. The inner plate, sheet and outer plate are spot welded together in a preferred embodiment of the present invention to form the cover of the switch housing.

A switch made in accordance with one particular embodiment of the present invention also comprises a pin that extends through and is attached to the generally circular raised surface of the protrusion. The pin comprises an outer portion extending from an outer surface of the raised surface and an inner portion extending from an inner surface of the raised surface. An external lever is attached to the external portion of the pin and an internal lever is attached to the internal portion of the pin. Movement of the external and internal levers in a coordinated manner is permitted by deformation of a deformable membrane portion of the raised surface of the protrusion.

BRIEF DESCRIPTION OF THE DRAWINGS

The present invention will be more fully and clearly understood from a reading of the Description of the Preferred Embodiment in conjunction with the drawings, in which.

DESCRIPTION OF THE PREFERRED EMBODIMENT

Figure 1:
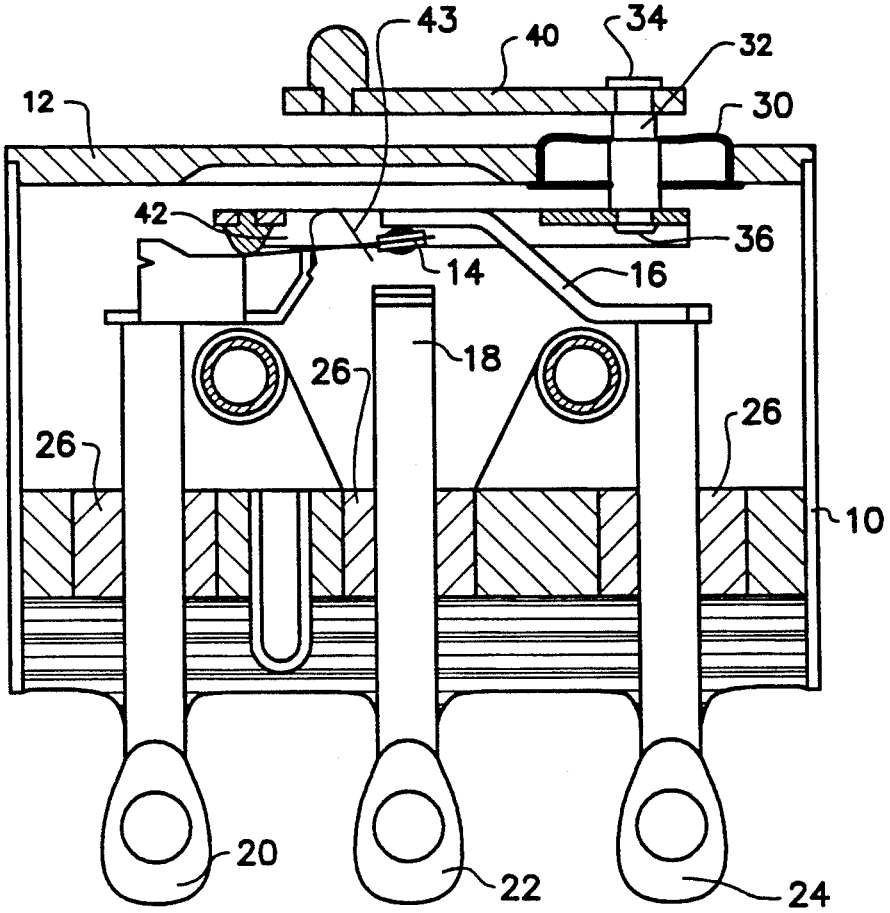
Fig. 1 (PRIOR ART)
FIG. 1 is a sectional view of a switch known to those skilled in the art.

Throughout the Description of the Preferred Embodiment, like components will be identified by like reference numerals. FIG. 1 shows a hermetically sealed switch that is known to those skilled in the art. The housing 10 has a switching mechanism disposed therein and a cover 12 attached to the housing 10 to enclose the switching mechanism inside. Since the switch shown in FIG. 1 is well known to those skilled in the art, the operation of the switching mechanism will not be described in detail herein other than to state that a moveable contact 14 is caused to alternately move into electrical communication with a first stationary contact 16 and a second stationary contact 18. The common lead 20, the normally open lead 22 and the normally closed lead 24 extend from the housing through glass bead seals 26. The cover 12 is provided with a deformable membrane 30 attached thereto. The deformable membrane 30, which will be described in greater detail below, is a generally circular surface of a cup-shaped member that is brazed to the cover 12. A pin 32 has an outer portion 34 and an inner portion 36 which are attached to an external lever 40 and an internal lever 42, respectively. In a manner which is generally known to those skilled in the art, the external lever 40, the internal lever 42 and the pin 32 move in a coordinated manner because of the generally rigid attachment of the two levers to the pin. The deformable membrane 30 can be distorted to permit the internal and external levers to move relative to the cover 12 and housing 10. This permits a movement of the external lever 40 to cause movement of the internal lever 42 to result in a change of connection status of the switching mechanism inside the housing.

Figure 2:
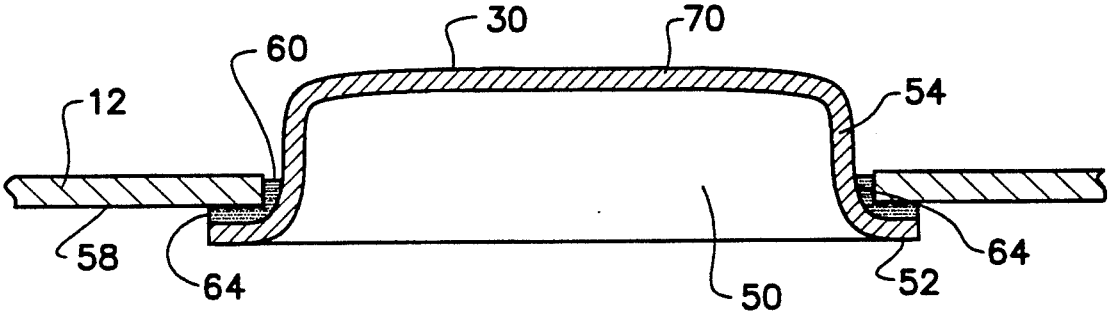
Fig. 2 (PRIOR ART)
FIG. 2 is an enlarged view of a portion of the switch in FIG. 1.

FIG. 2 is an enlarged view of the cover 12 and the cup-shaped member 50 which is brazed to it. The deformable membrane 30 is a generally circular raised surface of the cup-shaped member 50. The cup-shaped member 50 also comprises a generally annular rim portion 52 which is connected to the deformable membrane 30 by a generally cylindrical wall portion 54. The rim 52 is brazed to surface 58 of the cover 12 after the deformable membrane 30 is inserted through the opening 60 that is formed through the cover 12. The wall portion 54 of the cup-shaped member 50 is sized to permit the deformable membrane 30 and wall portion 54 to pass through opening 60. The rim 52 is sized to prevent complete passage of the cup-shaped member 50 through opening 60. When the cup-shaped member is disposed in the position shown in FIG. 2, the rim 52 is brazed to the cover 12, as represented by braze joint 64. In the central portion of the deformable membrane 30, a hole 70 is provided and shaped to receive segments of the inner and outer portions of the pin 32 which extends through the membrane 30 and is attached to it by welding. The pin, after it is rigidly attached to the deformable membrane 30, is then attached to the external lever and internal lever as described above in conjunction with FIG. 1.

With continued reference to FIG. 2, it can be seen that an inadequate braze flow during attachment of the cup-shaped member 30 to the cover 12 can result in a seal leak. An excessive amount of braze material results in a failure in corrosive environments and can also cause a stiffening of the cup-shaped member at its most highly stressed portion where the pin is attached to the deformable membrane. The increased stiffness of the deformable membrane can lead to fracture during mechanical cycling. The present invention is directed to a cover which avoids these types of brazed process variations which can cause these types of faults.

Figure 3:
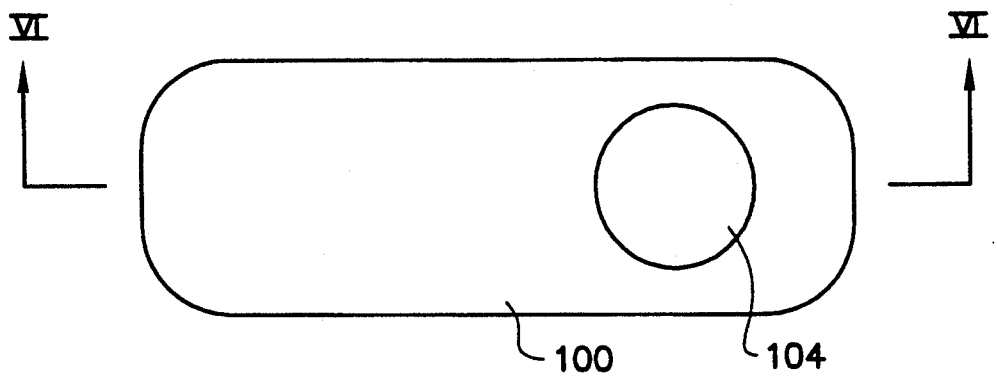
FIG. 3 is a top view of an outer plate of the present invention.
Figure 4:
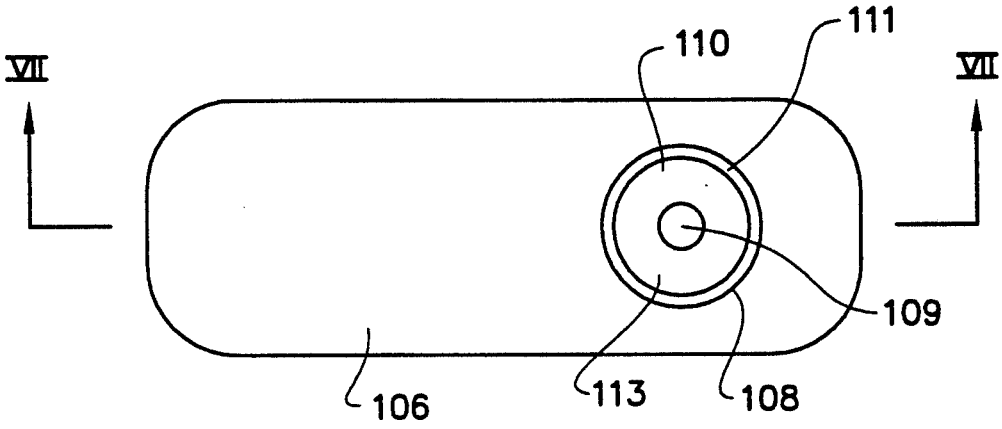
FIG. 4 is a top view of a metallic sheet of the present invention.
Figure 5:
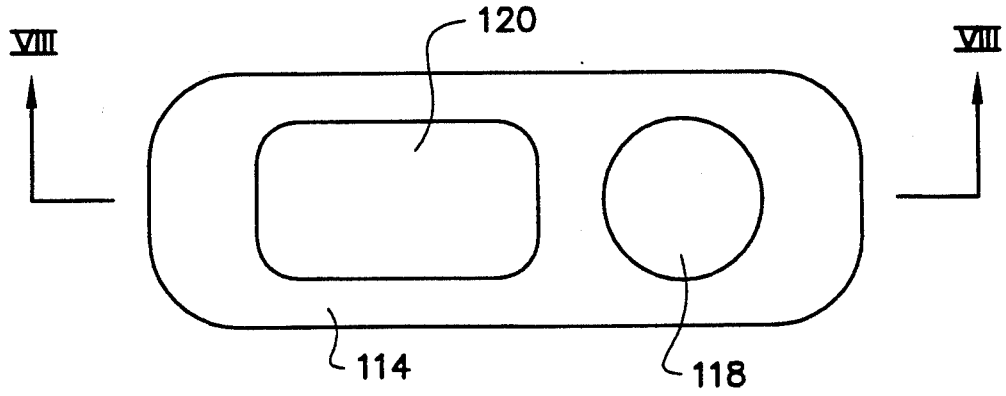
FIG. 5 is a top view of an inner plate of the present invention.

FIG. 3 shows an outer plate 100 of the present invention which has a generally circular opening 104 formed therethrough. FIG. 4 illustrates a metallic sheet 106 of the present invention with a protrusion 108 formed therein to define a generally circular raised surface 110 and a wall portion 112 (not shown in FIG. 4, but illustrated in FIG. 7). The generally circular raised surface 110 comprises a curved outer portion 111 and a generally planar surface 113 which has a central opening 109 formed through it in one specific embodiment of the present invention. The opening 109 is shaped to receive two portions of a pin which is attached to the planar surface 113. FIG. 5 illustrates an inner plate 114 that has a generally cylindrical opening 118 formed therethrough. In one specific embodiment of the present invention, the inner plate 114 also has a generally rectangular opening 120 formed therethrough to provide additional mechanical and dielectric clearance between the cover of the present invention and a portion of the switching mechanism, within the housing, which is at a different voltage potential than the cover of the switch. For example, the C-spring 43 shown in FIG. 1 can be at a voltage potential that is higher than the switch cover and the clearance provided by the rectangular opening 120 avoids contact between the C-spring 43 and the inner plate 114 of the cover. The purpose of opening 120 will be described in greater detail below.

Figure 6:
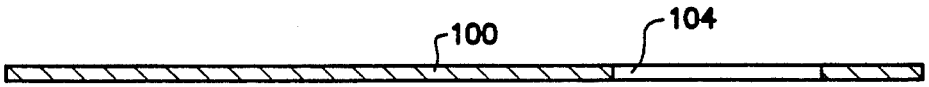
FIG. 6 is a sectional view of FIG. 3.
Figure 7:
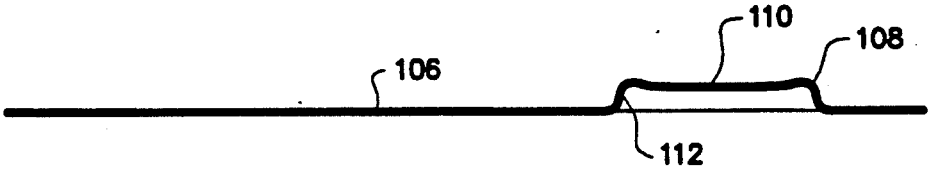
FIG. 7 is a sectional view of FIG. 4.

With reference to FIGS. 3 and 6, the opening 104 extends through the thickness of the outer plate 100. In a particularly preferred embodiment of the present invention, the outer plate is approximately 0.008 inches in thickness and is made of stainless steel. With reference to FIGS. 4 and 7, the protrusion 108 is shown as comprising a deformable membrane 110 connected to the planar portion of the sheet 106 by the wall portion 112. With reference to FIGS. 6 and 7, it can be seen that the metallic sheet 106 can be disposed in contact with a surface of the outer plate 100 with the protrusion 108 extending through opening 104. Opening 104 and protrusion 108 are sized to permit this type of assembly.

Figure 8:
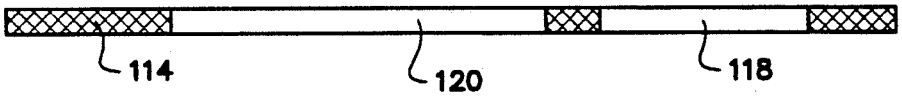
FIG. 8 is a sectional view of FIG. 5.

With reference to FIGS. 6 and 8, it can be seen that opening 118 in the inner plate 114 can be aligned with opening 104 in the outer plate 100 and the inner and outer plates can be disposed together with the metallic sheet 106 confined therebetween and the protrusion 108 extending through opening 104 in the outer plate 100. When assembled in this manner, the outer plate, the metallic sheet and the inner plate can be spot welded together to define a laminated cover.

With continued reference to FIGS. 6, 7 and 8, it should be noted that the length of the inner plate 114 is slightly less than the lengths of the outer plate 100 and metallic sheet 106. Therefore, when the three members are spot welded together as described above the outer plate 100 and metallic sheet 106 will extend outward from the edges of the inner plate 114.

Figure 9:
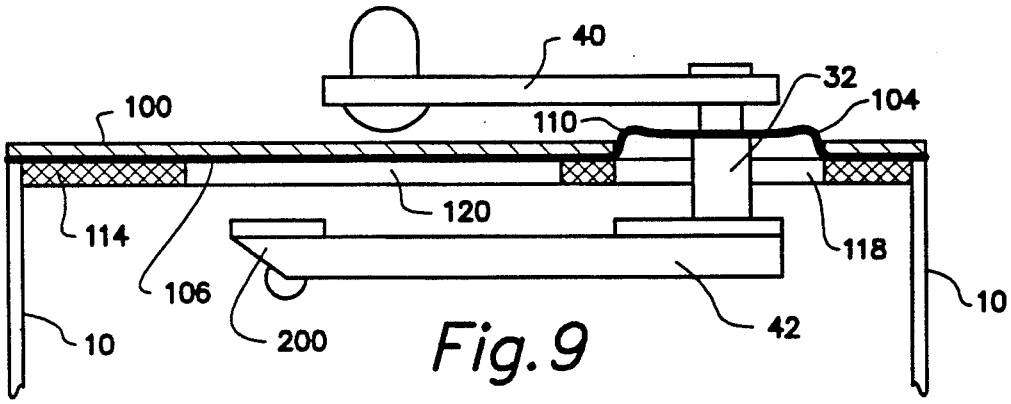
FIG. 9 is a sectional view of a switch made in accordance with the present invention.

FIG. 9 illustrates an assembled laminated cover made in accordance with the present invention and attached to a housing 10. The inner plate 114 and the outer plate 100 are arranged with their openings, 104 and 118, aligned with each other. In addition, the metallic sheet 106 is disposed between the outer and inner plates. The illustration of FIG. 9 also shows a pin 32 attached to external lever 40 and an internal lever 42 in a manner similar to that described above. The deformable membrane 110 is not brazed to the outer plate 100 in the region around opening 104 and therefore no braze joint, such as that identified by reference numeral 64 in FIG. 2, will result in the failure conditions described above when process variations lead to inadequate or excessive amounts of braze material flowing in the joint between the cup-shaped member and the other portions of the cover.

Figure 10:
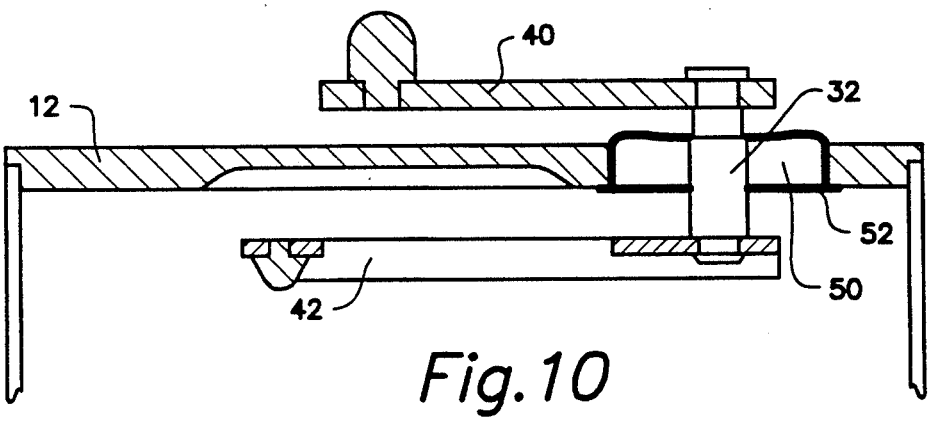
Fig. 10 (PRIOR ART)
FIG. 10 is a sectional view of a switch known to those skilled in the art.

FIG. 10 illustrates a switch that is generally known to those skilled in the art. The cup-shaped member 50 is attached, at its rim 52, to the cover 12, by brazing and, as described above, this places a braze joint at a location where process variations can result in the failures described above.

With reference to FIG. 9, it can be seen that the difference in dimensions between the lengths of inner plate 114 and outer plate 100 provides a lip where outer plate 100 and metallic sheet 106 extend outward from the edges of inner plate 114. This provides a lip against which the housing 110 can abut. After assembly of the cover to the housing, these two components are welded together at the corner formed by the edges of the cover and the upper edges of the housing 10.

With continued reference to FIG. 9 and FIGS. 6–8, it can be seen that the present invention retains the metallic sheet 106 in position without the necessity of brazing it in the region of opening 104. Instead, the sheet 106 is held between the inner and outer plates by the spot welds described above and the welds that attach the cover to the housing 10. These welds are remote from the locations where inadequate or excessive braze material resulting from process variations can cause the failure modes described above.

Although the present invention has been described in considerable detail and illustrated with specificity to show a preferred embodiment of the present invention, it should be understood that alternative embodiments are within its scope.

The embodiments of the invention in which an exclusive property or right is claimed are defined as follows:

1. A switch, comprising:

a housing;

a switching mechanism disposed within said housing;

a cover attached to said housing to enclose said switching mechanism, said cover comprising an outer plate, an inner plate and a sheet disposed therebetween, said sheet having a protrusion formed therein to define a raised potion of generally circular cross-section having a generally circular raised surface connected to a planar portion of said sheet by a generally annular wall portion, said outer plate having a generally circular first opening therethrough, said protrusion being disposed through said first opening, said inner plate having a generally circular second opening therethrough, said first and second openings being aligned with each other, said sheet being confined between said inner and outer plates;

a pin extending through and attached to said generally circular raised surface of said protrusion, said pin comprising an outer portion extending from an outer surface of said raised surface and an inner portion extending from an inner surface of said raised surface;

an external lever attached to said external portion of said pin;

an internal lever attached to said internal portion of said pin; and a third opening formed in said inner plate proximate a distal end of said internal lever to provide clearance for a portion of said switching mechanism.

2. The switch of claim 1, wherein:

said inner plate, said sheet and said outer plate are attached together to form said cover.

3. The switch of claim 1, wherein:

said internal lever is operatively associated with said switching mechanism to change the connection status of said switching mechanism.

4. The switch of claim 1, wherein:

said cover is welded to said housing.

5. A switch, comprising:

a housing:

a cover comprising an inner plate, an outer plate and a sheet disposed therebetween, said sheet having a protrusion formed therein, said protrusion having a generally circular raised surface, said outer plate having an opening therein, said protrusion extending through said first opening, said inner plate having a second opening therein, said first and second openings being aligned with each other, said sheet being disposed between said inner and outer plates, said inner plate, said outer plate and said sheet being attached together to form a cover, said cover being attached to said housing;

a switching mechanism disposed within said housing;

an external lever attached to an outer surface of said raised surface;

an internal lever attached to an inner surface of said raised surface, said internal lever being operatively associated with said switching mechanism to change the connection status thereof in response to movement of said external lever; and a third opening formed in said inner plate to provide clearance for a portion of said switching mechanism.

6. The switch of claim 5, further comprising:

a pin connected between said external lever and said protrusion and between said internal lever and said protrusion.

* * * * *